United States Patent [19]

Hutter

[11] 4,372,346

[45] Feb. 8, 1983

[54] ELECTRICAL WARP THREAD-MONITORING APPARATUS FOR A LOOM

[75] Inventor: Wilhelm Hutter, Roggwil, Switzerland

[73] Assignee: Aktiengesellschaft Adolph Saurer, Arbon, Switzerland

[21] Appl. No.: 178,640

[22] Filed: Aug. 15, 1980

[30] Foreign Application Priority Data

Sep. 3, 1979 [CH] Switzerland ..... 7938/79

[51] Int. Cl.[3] ..... D03D 51/28

[52] U.S. Cl. ..... 139/353; 28/187; 66/163; 340/870.01

[58] Field of Search ..... 139/353, 349, 336; 28/187; 66/163; 112/273; 340/677; 307/116

[56] References Cited

U.S. PATENT DOCUMENTS

| | | | |
|---|---|---|---|
| 3,324,899 | 6/1967 | Stagg, Jr. | 139/353 |
| 3,625,243 | 12/1971 | Hansen et al. | 139/336 |
| 3,863,241 | 1/1975 | Kamiyamaguchi et al. | 66/163 X |
| 4,178,590 | 12/1979 | Weidmann | 139/353 X |

FOREIGN PATENT DOCUMENTS

| | | |
|---|---|---|
| 555914 | 9/1974 | Switzerland . |
| 1054559 | 1/1967 | United Kingdom . |
| 1209728 | 10/1970 | United Kingdom . |

*Primary Examiner*—James Kee Chi

*Attorney, Agent, or Firm*—Werner W. Kleeman

[57] ABSTRACT

An electrical warp thread-monitoring apparatus for a loom wherein a multiplicity of warp threads each carry a drop wire which, in the presence of thread rupture, connects a pair of current rails which are mutually electrically insulated from one another, and thus, closes an alternating-current circuit. The alternating-current circuit possesses at its input side an alternating-current voltage source which can be connected by means of a bridge rectifier with the current rails. This bridge rectifier or rectifier circuit forms the input of a voltage-dependent pulse converter following which there is connected in circuit a RC-integration stage and a threshold value-switching stage, which also then produce a shutdown or stop signal when the contact locations are contaminated and prevent generation of a shutdown or stop signal when contaminants, leakage currents and dancing drop wires produce short pulses.

3 Claims, 1 Drawing Figure

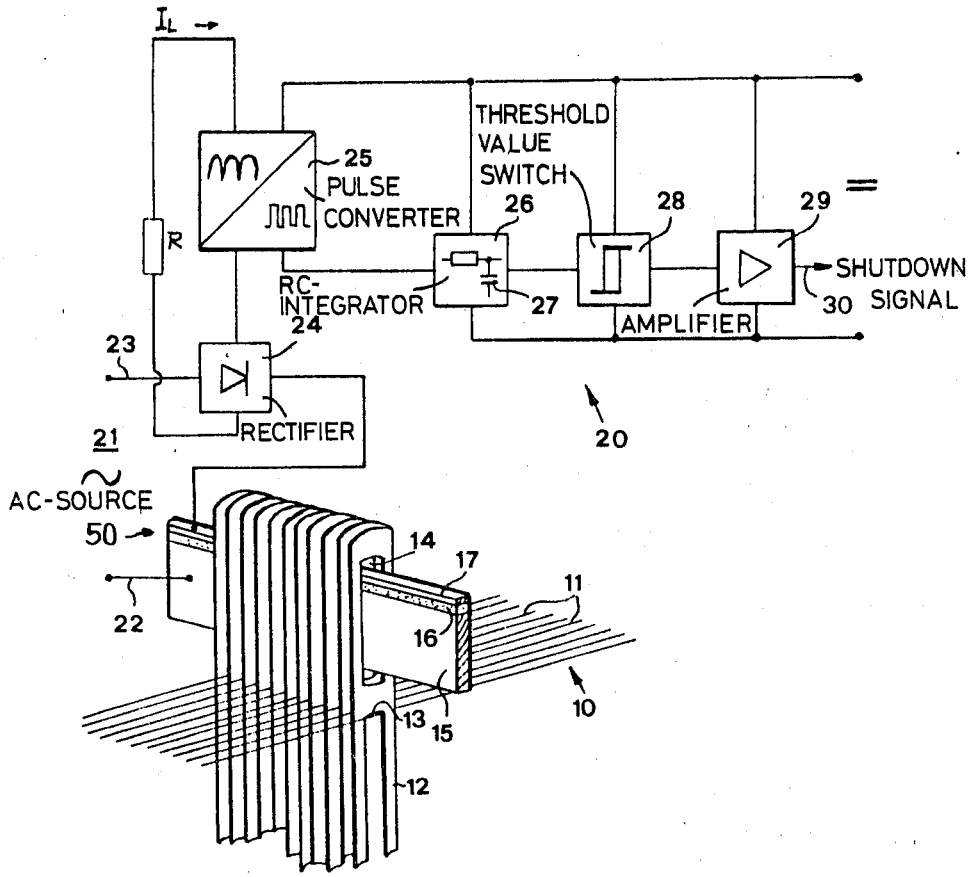
$I_L$
THRESHOLD
VALUE
SWITCH
25
PULSE
CONVERTER
26
28
29
R
RC-
INTEGRATOR
27
AMPLIFIER
SHUTDOWN
SIGNAL
30
24
23
RECTIFIER
20
21
AC-SOURCE
50
14
17
11
22
16
10
13
15
12

ELECTRICAL WARP THREAD-MONITORING APPARATUS FOR A LOOM

BACKGROUND OF THE INVENTION

The present invention broadly relates to stop motions for looms and, in particular, concerns a new and improved construction of an electrical warp thread-monitoring apparatus for a loom.

The warp thread-monitoring apparatus of the present development is of the type comprising a multiplicity and drop wires each carried by a warp thread and current rails which extend over the entire width of the warp threads. In the presence of rupture of a warp thread the current rails can be electrically connected with one another by the related drop wire which has dropped. The current rails are located conjointly in an alternating-current circuit in order to produce a stop or shutdown signal for the loom in the presence of warp thread rupture.

An entire host of requirements are placed upon equipment of this type, which for reasons of safety also must be maintained and which particularly arise by virtue of the varying surounding conditions at the region of the drop wires and the current rails during the weaving operation. Such conditions require, among other things, a spark-free contact to be made between the drop wires and the current rails. Additionally, there is required a positive functioning of the current circuit, and thus, a positive generation of a stop or shutdown signal even in the presence of increasing contamination during operation of the loom. Additionally, there must be prevented faulty functioning due to leakage currents, for instance arising in the presence of increased humidity, and finally, there must be avoided faulty response of the monitoring apparatus due to vibrating (dancing) drop wires.

None of the heretofore known electrical warp thread-monitoring apparatuses is however capable of satisfying all of the aforementioned requirements. In particular, the heretofore known warp thread-monitoring apparatuses are neither capable of preventing spark formation nor faulty operation in the presence of increasing fluff formation and/or increasing air humidity.

Thus, in Swiss Pat. No. 555,914 there has only been proposed connecting into the current circuit of an electrical warp thread-monitoring apparatus a time-delay relay, in order to enable response of the stop motion device at the loom only then when a current pulse of the warp thread-monitoring apparatus lasts beyond a predetermined period of time.

Furthermore, in British Pat. No. 1,054,559 there is taught to the art an arrangement wherein for increasing the contact between the drop wires and the contact rails there is employed a cold cathode tube. The employed circuit responds in the presence of the most brief pulses, as soon as such correspond to the ignition or firing potential. This is disadvantageous in as much as the cold cathode tubes also can be fired in the presence of leakage currents which, in practice, can flow between the contact rails due to the presence of contaminants (formation of snarls or fluff and moisture). Additionally, the circuit can respond in the presence of pulses which are formed due to vibration or dancing of the drop wires.

In British Pat. No. 1,209,728 there is taught a circuit arrangement wherein an integrator stage prevents response of the circuit to short pulses. Here however the response time is influenced so extensively by the transfer resistance at the warp thread monitor-drop wire-contact, which can fluctuate in practice between 0 and 30 Kilohms that there is precluded any positive switching operation.

SUMMARY OF THE INVENTION

Therefore, with the foregoing in mind it is a primary object of the present invention to provide a new and improved construction of an electrical warp thread-monitoring apparatus for a loom which is not associated with the aforementioned drawbacks and limitations of the prior art constructions.

Another and more specific object of the present invention aims at providing a new and improved construction of an electrical warp thread-monitoring apparatus of the previously mentioned type, which is capable of satisfying all of the requirements imposed thereon, even when operating over a longer period of time, and, in particular, insuring for a constantly positive function also in the presence of pronounced fluctuations of the operating conditions and suppressing faulty signals caused by leakage currents or dancing drop wires.

Now in order to implement these and still further objects of the invention, which will become more readily apparent as the description proceeds, the warp thread-monitoring apparatus of the present development is manifested by the features that the alternating-current voltage source which is connected at the input side by means of the current rails at the alternating-current circuit, is operatively connected by means of a bridge rectifier with the input of a voltage-dependent pulse converter, whose output signal constitutes a base signal for the shutdown signal.

It is preferred if a RC-integration stage is connected after the voltage-dependent pulse converter. Furthermore, it is advantageous if there is connected at the output of the RC-integration stage the input of a threshold value-switching stage which delivers the shutdown or stop signal for the loom.

By virtue of these measures it is now possible, apart from avoiding the formation of any type of sparks, to maintain an approximately linear output voltage even with varying contact transfer resistances between the drop wires and the current rails, by virtue of the voltage-dependent pulse converter which operates with the full operating current in the saturation region. Hence, there is possible a response even in the presence of pronounced formation of snarls or fluff at the contact locations. Additionally, upon falling below the lower operating current threshold the subsequently connected integrator and the threshold value-switching stage can suppress at the pulse converter an output signal which is produced for instance by a leakage current, so that also in this case there is prevented any faulty response. The same current circuit, integrator and threshold value-switching stage additionally prevent, by virtue of their time-delay characteristic, the generation of a shutdown or stop signal due to current pulses because of dancing of the drop wires.

BRIEF DESCRIPTION OF THE DRAWINGS

The invention will be better understood and objects other than those set forth above, will become apparent when consideration is given to the following detailed description thereof. Such description makes reference to the annexed drawing wherein the single FIGURE shows in partial perspective and partial block circuit diagram an electric warp thread-monitoring apparatus for a loom according to the invention.

DETAILED DESCRIPTION OF THE PREFERRED EMBODIMENTS

Describing now the drawing, reference character 10 designates the warp of a loom, this warp 10 being formed by a large number of mutually parallel warp threads 11. Each warp thread 11 carries a drop wire 12 or equivalent structure formed of at least partially electrically conductive material. Each drop wire 12 is seated by means of a web 13 upon the related warp thread 11. Now if a warp thread 11 ruptures, then the corresponding drop wire 12 drops downwards.

All of the drop wires 12 are threaded on to a contact rail arrangement 50, which as a rule extends transversely across the entire loom. This contact rail arrangement 50 piercingly extends in a contact-free manner through each related window or opening 14 of each drop wire 12. In the embodiment under discussion, this contact rail arrangement 50 comprises a first current rail 15, an insulating layer 16 and a second current rail 17. The current rails 15 and 17 are formed of any suitable electrically conductive material, and the first current rail 15 extends in an upright fashion through the drop wires 12 and carries at its upper edge, separated by the insulation layer 16, the second current rail 17.

Thus if in the presence of rupture of one of the warp threads 11 the related drop wire 12 drops downwards, then such drop wire comes into contact with the edge of its opening or window 14 both with the upper current rail 17 and also with one side or face of the contact rail 15. This produces an electrical connection between the current rails 15 and 17, and as a result there is closed the current circuit 20 which will be more fully described hereinafter.

At its input side the current circuit 20 contains an alternating-current voltage source 21, the one output 22 of which is electrically connected with the first current rail 15 and the other output 23 of which is connected by means of a Graetz or bridge rectifier 24 with the second current rail 17.

This rectifier circuit 24 forms at its direct-current side the input of a voltage-dependent pulse converter 25. This pulse converter 25 can be, for instance, an optocoupler having a normally controlled phototransistor or a special transformer or a Schmitt-trigger and which converts the input-side half wave signals into square or topped pulses which are applied to the input of a RC-integration stage 26. This RC-integration or integrator stage 26 has connected thereafter a threshold value-switching stage 28 which, on the one hand, operates as a time-delay element and, on the other hand, as a threshold value switch. Connected at the output side of the threshold value-switching stage 28 is an output signal amplifier 29 which, in the presence of warp thread rupture, delivers the shutdown or stop signal 30 for the loom.

The alternating-current voltage source 21 advantageously only delivers a comparatively small voltage, wherein also in the presence of the greatest possible current, governed by the resistor or resistance R, there is ensured that sparks cannot form at the contact locations between a drop wire 12 and the current rails 15 and 17.

Since the voltage-dependent pulse converter 25 operates at the full operating current in the saturation region, the square wave pulses formed during contact making by a drop wire 12 and appearing at the output of the pulse converter 25 produce an approximately linear voltage at the capacitor 27 of the RC-integration stage 26 even with markedly fluctuating current $I_L$ in the input circuit owing to different contact transfer resistances between the drop wires 12 and the current rails 15 and 17. This ensures that also then there will be reliably produced a shutdown or stop signal for the loom, if the contact locations between the drop wires 12 and the current rails 15 and 17 with time are heavily covered with fluff or snarls.

Upon exceeding the lower operating current limit the voltage at the capacitor 27 of the RC-integration stage 26 can steeply drop. In this way there is ensured that possible input-side leakage currents caused by pronounced contamination and/or high air humidity at the region of the current rails 15 and 17 cannot produce any undesired shutdown or stop signal 30.

Furthermore, due to a preselected time-delay characteristic of the RC-integration stage 26 and the threshold value-switching stage 28 there is ensured that the previously described circuit arrangement responds with such a time-delay that brief current pulses caused by dancing or jumping around of the drop wires 12 cannot produce any shutdown or stop signal 30 at the output side of the amplifier stage 29.

Therefore, with the described electrical warp thread-monitoring apparatus it is possible to completely fulfill all of the previously mentioned conditions or requirements.

While there are shown and described present preferred embodiments of the invention, it is to be distinctly understood that the invention is not limited thereto, but may be otherwise variously embodied and practiced within the scope of the following claims. Accordingly

What I claim is:

1. An electrical warp thread-monitoring apparatus for a loom for monitoring warp threads, comprising:

a plurality of drop wires;

each of said drop wires being supported by a re-related warp thread;

current rails extending over the entire width of the warp threads;

said current rails being electrically connected with one another upon rupture of at least one of the warp threads by the related drop wire which drops into contact with said current rails;

means defining an alternating-current circuit in which there are conjointly arranged said current rails in order to generate a shutdown signal for the loom in the presence of rupture of a warp thread;

an alternating-current voltage source connected by means of said current rails with an input side of said alternating-current circuit;

said means defining said alternating-current circuit comprising:

a voltage-dependent pulse converter having an input side; and a bridge rectifier;

said alternating-current voltage source being connected by means of said bridge rectifier with said input side of said voltage-dependent pulse converter; and said pulse converter delivering an output signal constituting a base signal for the shutdown signal.

2. The electrical warp thread-monitoring apparatus as defined in claim 1, wherein:

said means defining said alternating-current circuit further includes a RC-integration stage connected after said voltage-dependent pulse converter.

3. The electrical warp thread-monitoring apparatus as defined in claim 2, wherein:

said RC-integration stage has an output side;

said means defining said alternating-current circuit including a threshold value-switching stage having an input side;

said input side of said threshold value-switching stage being connected with the output side of said RC-integration stage; and said threshold value-switching stage delivering said shutdown signal for the loom.

* * * * *